US011127580B2

(12) United States Patent
Enke

(10) Patent No.: US 11,127,580 B2
(45) Date of Patent: Sep. 21, 2021

(54) DETECTOR SYSTEM FOR TARGETED ANALYSIS BY DISTANCE-OF-FLIGHT MASS SPECTROMETRY

(71) Applicant: Christie Enke, Placitas, NM (US)

(72) Inventor: Christie Enke, Placitas, NM (US)

(73) Assignee: UNM Rainforest Innovations, Albuquerque, NM (US)

( * ) Notice: Subject to any disclaimer, the term of this patent is extended or adjusted under 35 U.S.C. 154(b) by 0 days.

(21) Appl. No.: 15/733,109

(22) PCT Filed: Nov. 16, 2018

(86) PCT No.: PCT/US2018/061420
§ 371 (c)(1),
(2) Date: May 18, 2020

(87) PCT Pub. No.: WO2019/099763
PCT Pub. Date: May 23, 2019

(65) Prior Publication Data

US 2020/0357624 A1 Nov. 12, 2020

Related U.S. Application Data

(60) Provisional application No. 62/587,536, filed on Nov. 17, 2017.

(51) Int. Cl.
*H01J 49/40* (2006.01)
*H01J 49/02* (2006.01)

(52) U.S. Cl.
CPC ..... *H01J 49/403* (2013.01); *H01J 49/022* (2013.01); *H01J 49/025* (2013.01)

(58) Field of Classification Search
CPC ..... H01J 49/022; H01J 49/025; H01J 49/40; H01J 49/401; H01J 49/403; H01J 49/405
See application file for complete search history.

(56) References Cited

U.S. PATENT DOCUMENTS 7,429,728 B2 * 9/2008 Enke ..... G01N 27/622 250/281
7,947,950 B2 * 5/2011 Enke ..... H01J 49/40 250/290
8,378,296 B1 * 2/2013 Enke ..... H01J 49/025 250/288
8,604,423 B2 * 12/2013 Enke ..... H01J 49/0031 250/287
8,648,295 B2 * 2/2014 Enke ..... B01D 59/44 250/287
2014/0138538 A1 * 5/2014 Hieftje ..... H01J 49/34 250/282

* cited by examiner

*Primary Examiner* — David E Smith
(74) *Attorney, Agent, or Firm* — Gonzales Patent Services; Ellen Gonzales

(57) ABSTRACT

A detector system for targeted analysis and/or sample collection by distance-of-flight mass spectrometry (tDOF-MS).

21 Claims, 3 Drawing Sheets

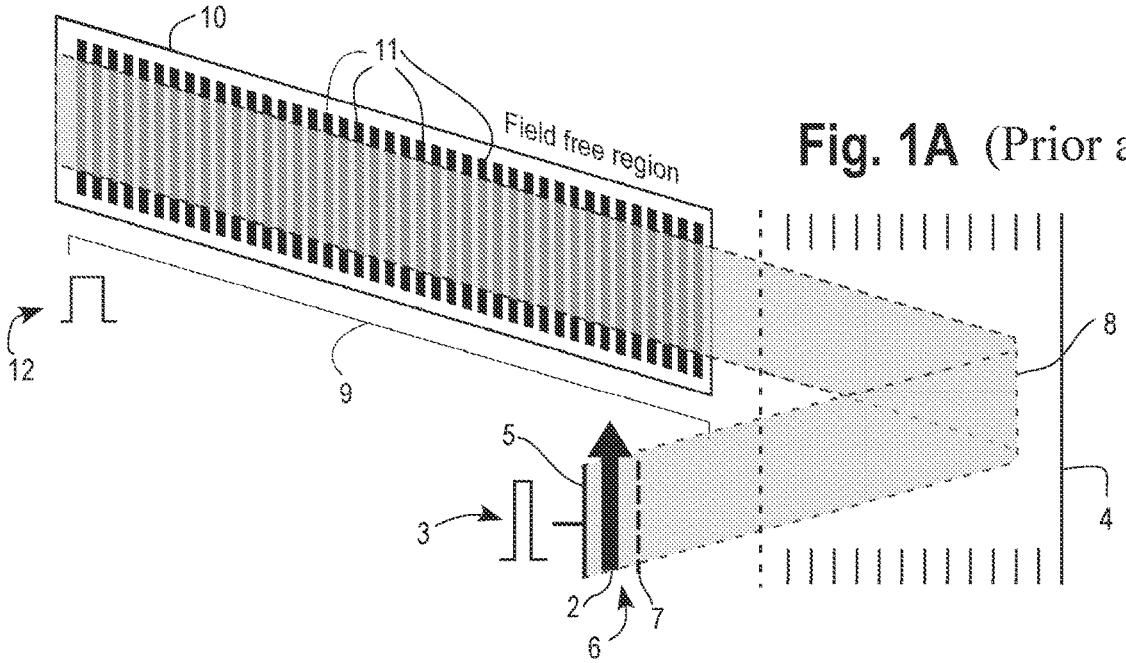
Fig. 1A (Prior art)
Fig. 1B (Prior art)
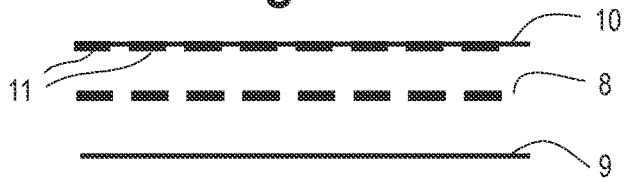
Fig. 2
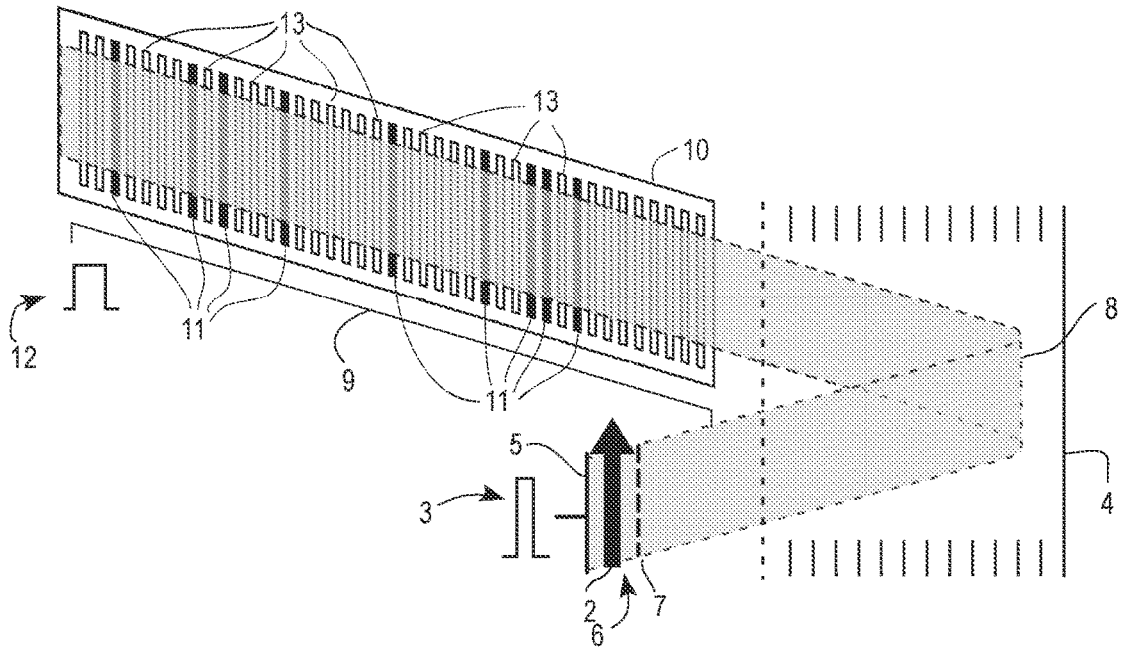

DETECTOR SYSTEM FOR TARGETED ANALYSIS BY DISTANCE-OF-FLIGHT MASS SPECTROMETRY

CROSS-REFERENCE TO RELATED APPLICATIONS

The following application claims benefit of U.S. Provisional Application No. 62/587,536, filed Nov. 17, 2017, which is hereby incorporated by reference in its entirety.

BACKGROUND

Distance-of-flight mass spectrometry (DOF MS) uses mass separation based on the distance ions of various m/z values will travel in a given amount of time. Exemplary DOF MS apparati are shown and described in, for example: U.S. Pat. No. 7,041,968, issued May 9, 2006; U.S. Pat. No. 7,947,950, issued May 24, 2011; U.S. Pat. No. 8,378,296, issued Feb. 19, 2013; U.S. Pat. No. 8,604,423 issued Dec. 10, 2013; and U.S. Pat. No. 8,648,295 issued Feb. 11, 2014, each of which is hereby incorporated by reference for all purposes. The basic concept is shown in FIG. 1. Ionized sample molecules are focused into a beam as shown by the arrow 2. A short voltage pulse 3 accelerates the ions in this beam into an ion mirror 4. The accelerating pulse from acceleration plate 5 is terminated before any ions of interest have left the acceleration region 6 via exit grid 7. Such acceleration provides all the ions with the same momentum. The ion mirror 4 has a linear retarding field that turns the ions around forming a ribbon shaped beam 8 that runs between a flat push plate 9 and an array 10 of ion detector elements 11. At a specific time, called the energy focus time, a voltage 12 is applied to the push plate 9 to drive the ions to the detector element corresponding to each ion's position at the time of the pulse. At this time, due to the action of the mirror and the selection of the time of the push plate pulse, the ions are focused with respect to their initial differences in energy, but their initial differences in distance from the acceleration region exit are not corrected. The initial spatial dispersion remains constant. FIG. 1B is a top down partial view of the DOF MS apparatus of claim 1 illustrating the spatial relationship between the push plate 9, the ion beam 8, and the array 10 of detector elements 11.

For maximum mass resolution, one would like the width of the detector elements to be no larger than the dispersion of ions of a single m/z. For maximum range of m/z's detected, the length of the detection region should be as long as practical. These two goals require some compromise because the cost of the detector system will increase more than proportionally to the number of detectors per cm and the length of the detector region will factor at least linearly to the cost of the detector. It is fair to say that the lack of inexpensive options for an ion array detector has been the main inhibitor to the adoption of distance-of-flight mass spectrometry. It is also true that the longer the detector region, the less the detector density needs to be to achieve the same resolution. A longer detection region is more easily achieved with a few individual detectors than it is when the entire detection region is filled with detectors.

The detector cost/tradeoff is unfortunate as DOF MS is otherwise very simple to implement and can be readily miniaturized. It requires only two pulses precisely timed with respect to each other, the acceleration pulse and the detection pulse. Detection can be with simple charge detection strips that require neither precision measurement timing nor high-speed analog-to-digital converters. Charge detection is far less noisy than the use of electron multiplier ion detection and has no upper mass limit. One could, in principle, use DOF to separate huge molecules and even microorganisms. Finally, having many detectors invokes Felget's advantage over having all the information coming from one detector at the end of the flight path as is the case with time-of-flight mass spectrometers.

SUMMARY

According to various embodiments, the present disclosure provides a detector system for targeted analysis and/or sample collection by distance-of-flight mass spectrometry (tDOF-MS).

BRIEF DESCRIPTION OF THE DRAWINGS

FIG. 1A is a schematic illustration of a standard Distance-of-flight mass spectrometry (DOF MS) apparatus.

FIG. 1B is a top down partial view of the DOF MS apparatus of claim 1 illustrating the spatial relationship between the push plate, the ion beam, and the detector elements.

FIG. 2 is a schematic illustration of a DOF-MS apparatus optimized for targeted analysis (tDOF-MS).

DETAILED DESCRIPTION

According to an embodiment, the present disclosure provides a detector system for targeted analysis by distance-of-flight mass spectrometry (DOF-MS). In targeted analysis, one is interested in detecting a specific sample component or type of component. When mass spectrometers are used for targeted analysis, the response of only a few m/z values is of interest. In general, one wants to detect ions of all the m/z values that are characteristic of that component and confirm the lack of ions of any m/z value that could lead to a false positive. This is accomplished with only a small number of m/z detection values. The rest of the mass spectrum is not used. Therefore, for targeted analysis with DOF MS, most of the detection system would not be used, which would be a waste of expensive hardware.

Accordingly, the present disclosure provides a DOF MS apparatus optimized for targeted analysis (tDOF-MS). For the purpose of the present disclosure, the terms "target," and "target analyte" refer to ions, molecules, complexes, molecular assemblies, or other analyte species with predefined m/z values or ranges of values that the presently disclosed instrument is designed to detect. For the purposes of simplicity, the disclosure may refer to "ions," "molecules" or "analytes" without referring to the others and such references should be interpreted as including all of these possibilities unless context or specific language dictates otherwise. Likewise, a "sample" refers to a group of ions, molecules or other analytes that includes or is suspected of including one or more targets.

Figure 3:
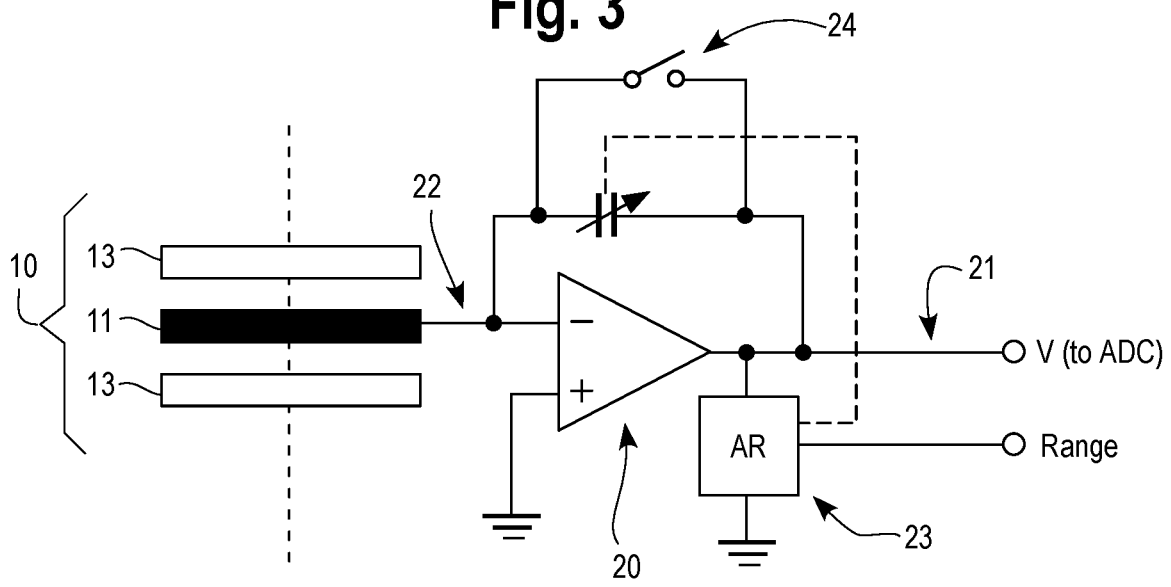
FIG. 3 is an exemplary circuit diagram for use in a detector system for a tDOF-MS apparatus of the present disclosure.

Exemplary embodiments of a tDOF-MS according to the present disclosure are provided in FIGS. 2 and 3.

Turning first to FIG. 2, an exemplary embodiment of a tDOF-MS is depicted. The tDOF-MS of FIG. 2 corresponds more or less to the DOF-MS shown in FIG. 1 but, as described in greater detail below, includes a mix of active 11 detector/collector elements optimized for target-specific detection and/or collection and inactive dummy elements 13.

As with the DOF-MS, in the tDOF-MS, an ionized sample including (or suspected of containing) the specific target(s) of interest are focused into a beam as shown by the arrow 2. A short voltage pulse 3 accelerates the ions in this beam into an ion mirror 4. Like the embodiment in FIG. 1, the accelerating pulse from acceleration plate 5 is terminated before any ions of interest have left the acceleration region 6 via exit grid 7, thereby providing all the ions with the same momentum.

The mirror 4 has a linear retarding field that turns a ribbon shaped beam 8 of ions around to run between a flat push plate 9 and an array 10 of detector/collector elements 11 and dummy elements 13. Like the embodiment shown in FIG. 1, at the energy focus time, a voltage 12 is applied to the push plate 9 to drive the ions to the array element corresponding to each ion's position at the time of the pulse. At this time, due to the action of the mirror and the selection of the time of the push plate pulse, the ions are focused with respect to their initial differences in energy, but their initial differences in distance from the acceleration region exit is not corrected. The initial spatial dispersion remains constant.

As mentioned above, unlike the DOF-MS instrument shown in FIG. 1, in a tDOF-MS instrument of the present disclosure, the array 10 includes both detector/collector elements 11 and non-detecting "dummy" elements 13. For the purposes of the present disclosure, a "detector element" is an element which is operably connected to a charge detection circuit or device (which may take the form of an amplifier, integrator, or auto-ranging circuit or any combination thereof), such that an ion or charged analyte, upon contact with the detector element, produces, sends, or in some manner causes an identifiable signal to be communicated to an operator, thereby indicating to the operator the presence of an ion with the pre-defined m/z value of interest within the sample being tested. Accordingly, the detector elements are specifically positioned within the array so that they will capture only targets having the specific predetermined m/z values of interest. Non-targets having m/z values which are not of interest are received by the non-detecting, or "dummy" elements 13. For the purposes of the present disclosure, a non-detecting element is an element which is not operably connected to a signaling circuit. However, according to various embodiments, the non-detecting element is connected to the detector circuit common or to a voltage source of the same potential as initially on the detection elements. Non-detecting elements may be discreet as shown or contiguous with adjacent non-detecting elements. For the purposes of the present disclosure, a "collecting element" is an element which is capable capturing an ion, charged analyte, etc. in such a way that the captured ion, analyte, etc. can then be recovered, perhaps for further processing or analysis. According to various embodiments, a single element may be both a detector element and a collecting element or a dummy element and a collecting element, though the former is probably more common. It is also possible to have a detector element that is not a collecting element. Accordingly, while a particular embodiment may be described herein as including detector elements, it will be understood that these elements could also be collector elements and vice versa.

Of course it will be understood that other arrangements for the DOF-MS are possible and have been previously described. For example, arrangements without an ion mirror have been described and may be suitable for certain applications, including certain applications wherein targeted analysis may be desirable. Accordingly, such arrangements are contemplated by the present disclosure.

FIG. 3, shows an array of elements 10 with a detector element 11 operably connected to a signaling circuit 20. As described above, the ion beam passes in a path parallel to the array, and, at the detection time, is deflected to land on the array elements, some of which are detector/collector elements 11 and some of which are non-detecting dummy elements 13. The signaling circuits may or may not be in the same plane as the collector elements.

In the depicted embodiment, the signaling circuit is shown as a charge-to-voltage (Q-V) converter circuit based on an operational amplifier 20. In general, the sensitivity of the circuit will depend on the capacitance of the capacitor connected between the operational amplifier (op amp) output 21 and its inverting input 22. An auto-ranging circuit 23 monitors the Q-V converter output voltage. If it is headed out of range, it causes the integrating capacitance to increase. This can be done by switching a larger capacitance in parallel with the one shown or using some sort of variable capacitance arrangement. The amount of the charge accumulated on the detector element is a combination of the voltage at the op amp output 21 and a signal that indicates the sensitivity scale or range of the Q-V converter. This signal is preferably digital but could be analog. The amount of accumulated charge can be acquired from these signals at any time or continuously. In tDOF-MS, it would be typically acquired at the end of an acquisition period, though the acquisition period could be affected by the accumulated charge reading on one or more of the detector strips. The detection circuit is reset or cleared by closing switch 24.

In another embodiment, the detection amplifier could have a logarithmic or other non-linear response function such that the same precision is maintained over a very wide range of detected charge. As in the previous embodiment, the output signal representing the logarithm of the accumulated charge would be read out at the end of an acquisition period.

One consequence of a DOF-MS system is that the collectors remain active, with the accumulated charge of all previous ion extractions until cleared. According to some embodiment it may therefore be desirable or advantageous for the detector circuits to have auto-ranging capability. The dynamic range of a mass spectrometer is the ratio of the largest practical detector response to the smallest. With a TOF-MS, the detector is a charge-multiplication device which can be damaged by too large a detector current. The sample concentration is adjusted to keep this from happening at the m/z of the most abundant compound. There is also a limit of detection which is just above the noise threshold. The dynamic range is the ratio of the response to the most abundant compound to that at the limit of detection. This ratio is generally on the order of 10,000. Accordingly, it is a fundamental limit caused by the presence of both large abundance and very low-abundance compounds in the same sample and the use of just one detection system for all the m/z values.

When multiple auto-ranging detectors are used, there is no such limit. The m/z values of the low-abundance compounds land on detectors set to high sensitivities and the detectors detecting the high-abundance compounds automatically adjust their range to accommodate the much larger amount of charge collected. This provides a dynamic range far in excess of that available with standard TOF or quadrupole-based systems. Accordingly, in a tDOF-MS system, the fact that the detectors remain active can provide a significant advantage of standard TOF or quadrupole-based systems.

Figure 4:
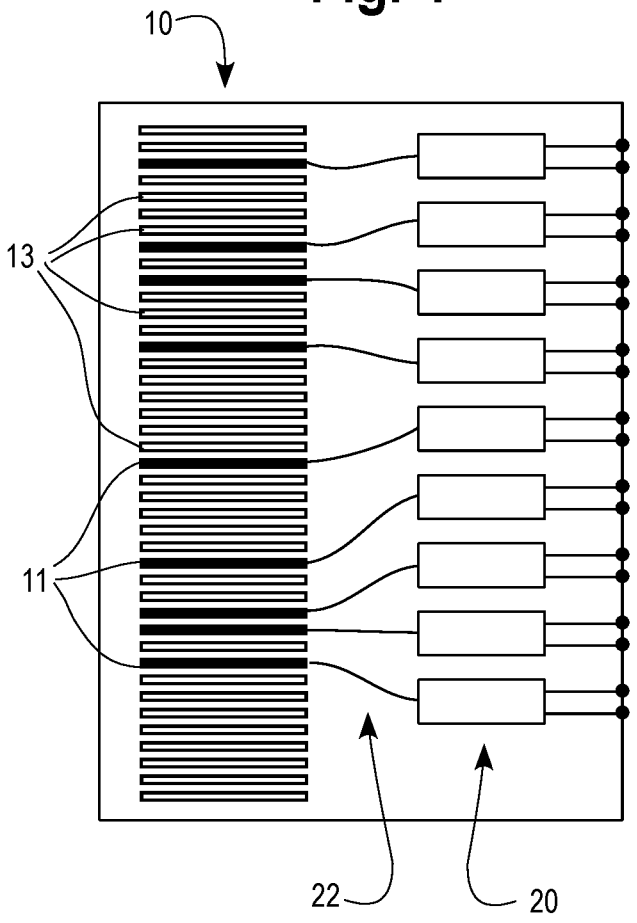
FIG. 4 is a schematic illustration of a detector system for a tDOF-MS apparatus of the present disclosure.

In FIG. 4, the array comprises detector elements 10 and dummy elements 11. As shown, in this embodiment, each detector element 10 is connected to a signaling circuit 20 via mass-assignment connectors 22. However, as discussed in greater detail below, according to some embodiments, it may be desirable for more than one detector element to be connected to a single Q-V circuit.

It will be appreciated, however, that not all of the circuit elements shown in FIGS. 3 and 4 are necessary, depending, for example, on the purpose of the instrument and the target being analyzed. For example, if the mass spectrum of the target compound or element is known, then the relative intensities of the ions in its mass spectrum will also be known. In this case, the sensitivity of each of the detector amplifiers could be tailored according to the relative abundance of the ions expected for the m/z value it is detecting, negating the need for an auto-ranging circuit. According to an embodiment, the amplifier (e.g., a charge-to-voltage converter) sensitivity is set by the capacitance of the capacitor in the operational amplifier feedback circuit.

According to some embodiments, the locations and capabilities of the detector and dummy elements are static and each detector element is permanently connected to a signaling circuit, while the dummy elements are then connected together and to a circuit common, or ground. However, according to other embodiments, the collector elements may be "programmable." That is, some or all of the collector elements may all be capable of acting as either detector or dummy elements, depending on whether or not they are operably connected to a signaling circuit. To enable, or program, a collector element to act as a detector element, the collector element associated with the m/z values of interest is connected to a detector circuit input and the collector elements associated with m/s values not of interest are connected to each other and a circuit common. It will be understood that the instrument could be designed so that an operator could switch individual (or groups of) collector elements from acting as detector elements to acting as dummy element (or vice versa) in order to change the m/z values (and thus molecules of interest) the instrument is capable of detecting. For example, each collector element could be connected to both an individual signal detection circuit and to the common "dummy" circuit and an operator-controlled electronic switch or physically moveable contacts could be provided that change the connection from one to another.

It will be appreciated that the design and arrangement of the detector and dummy elements (as well as the circuits to which they are connected) may be determined by the m/z values of the molecules being detected and/or by the intended use of the instrument. For example, a dedicated instrument which is intended to test for only a select set of target molecules may be designed to include only one or a few permanently positioned, non-programmable detector elements interspersed between non-programmable dummy elements. While a "multi-use" or adaptable instrument might come with programmable elements, as described above.

Figure 5:
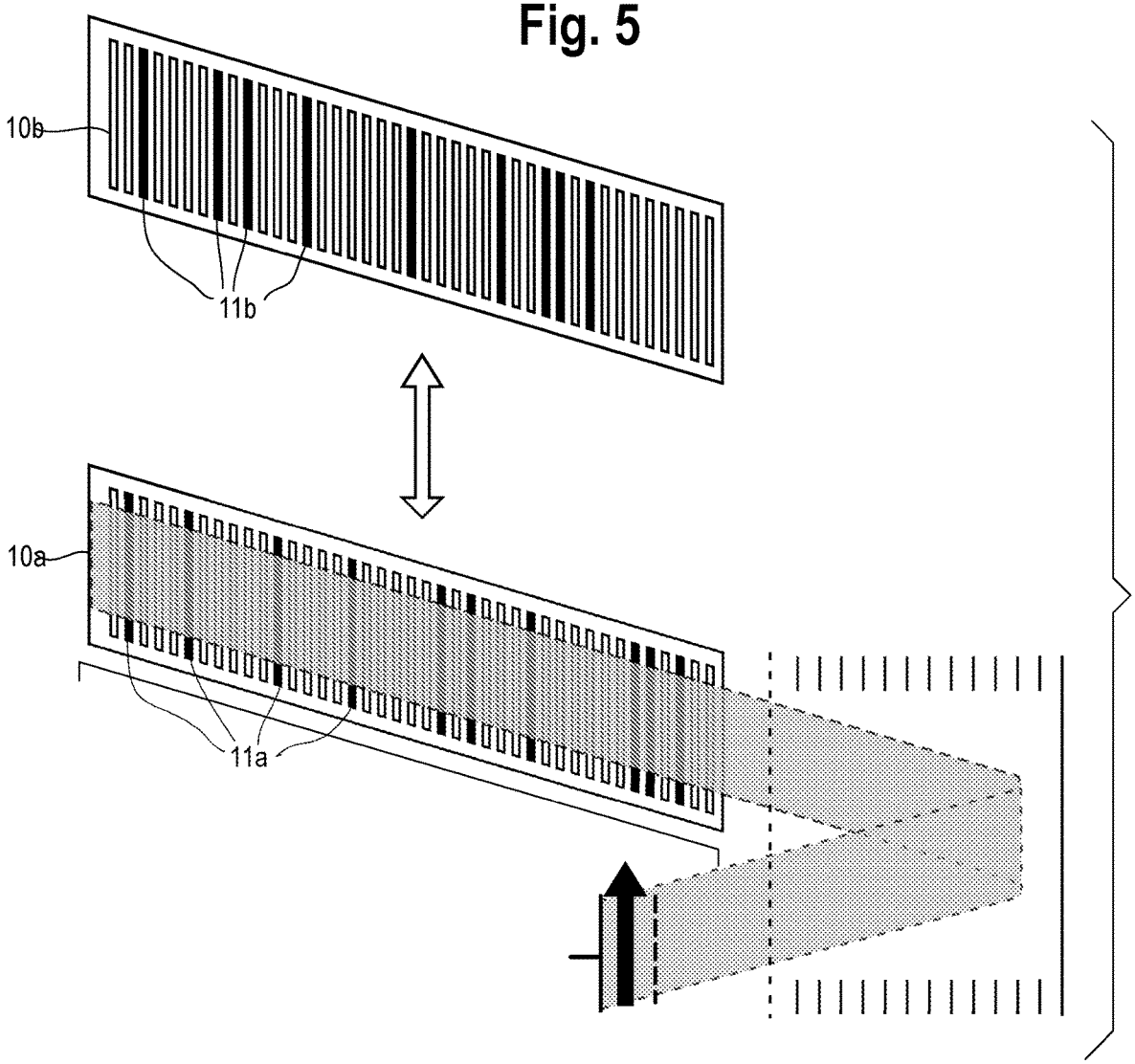
FIG. 5 is a schematic illustration of a tDOF-MS apparatus according to the present disclosure having interchangeable detection cartridges.

Alternatively, or additionally, a "multi-use" instrument could include a series of exchangeable detection cartridges that could be swapped in and out to enable the same general instrumentation to be used to detect (i.e. signal the presence of) different sets of molecules of interest. An exemplary cartridge system is shown in FIG. 5, wherein a first cartridge 10*a* includes detector elements 11*a* in a first configuration and a second cartridge 120 includes detector elements 11*b* in a second configuration. Cartridge 10*a* may thus be configured to signal the presence of a first set of molecules (e.g., markers for toxic substance A) while cartridge 10*b* may be configured to signal the presence of a second set of molecules (e.g., markers for toxic substance B). Of course it will be appreciated that a near infinite number of cartridges and configurations as possible. For example cartridge 10*a* could be designed to detect the presence of a larger number of m/z values corresponding to a "broader" assortment of molecules while cartridge 10*b* (or any number of other subsequent cartridges) could be designed to detect for the presence of a more limited assortment of molecules within the broader assortment (effectively narrowing down the types of molecules present in the sample being analyzed). Alternatively, cartridges 10*a* and 10*b* could signal the presence of only some of the same m/z values or entirely non-overlapping m/z values. Moreover, cartridges 10*a* and *b* may or may not contain programmable elements.

In another embodiment, the detector elements could be mechanically moveable along the detection axis. In this embodiment, the determination of the target analyte and its characteristic m/z values would be controllable by the user. The detector elements could be moved by rack and pinion, by sliding along a track, by a screw adjustment where a long lead screw through a block behind the element set its position, or some other type of mechanical positioning device. The setting of the positions could be made with the detector system removed from the vacuum or by positioning knobs or screws projecting through the vacuum container walls. Of course it will be understood that non-signaling dummy elements would need to be configured so as to fill in the spaces between the detector elements.

Of course it will be appreciated that various combinations and variations of the above-described mechanical and electronic configurations could be used to design a nearly infinite number of dedicated or multi-use instruments and that such combinations and variations are contemplated by the present disclosure. to optimize the detection capability of the instrument for specific target analytes. For example, the detector element can be shaped, sized, or positioned, to capture all or the most abundant isotopic masses of the analyte or just selected ones. It can be very narrow for high mass resolving power, or wider for more sensitivity. As an example, compounds generally do not have just one m/z because of the isotopes of the elements they contain. For example, 1% of the carbon has an atomic mass of 13 instead of the more common 12. Therefore, to detect the entire amount of a particular compound (or element) one could send the signal from more than one detector strip to a single Q-V converter circuit. Alternatively, the instrument could be designed to have a wider detector element when adjoining m/z values are to be sent to a single circuit input.

Figure 6:
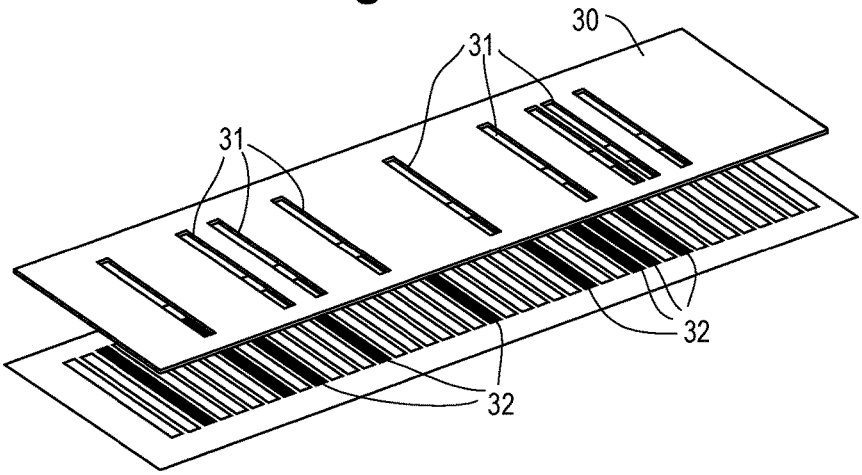
FIG. 6 is a schematic illustration of a tDOF-MS apparatus of the present disclosure including a sample collection mechanism.

It will be appreciated that the presently described apparatus enables target detection via physical separation of the molecules within the sample, based on m/z values. Accordingly, in yet another embodiment, the presently described instrument takes advantage of this physical separation, not just for detection, but also for sample collection. Specifically, the presently described instrument can be designed to isolate, collect, and recover, target molecules having specific m/z values. An exemplary embodiment of a tDOF-MS designed for sample collection is shown in FIG. 6. In the depicted embodiment, a dummy plate 30 is a planar piece of metal or other conducting surface with slots 31 at the distances where ions of interest are expected to be detected. It should be understood that for the purposes of the present disclosure, the term "slot" is used simply to refer to an opening and that no specific shape is intended by this term, as the required shape will be determined by the specific design of the instrument, the flight path of the ions, and the ions being detected. Behind these slots are collection elements 32, whose potential is set to attract the ions of interest. In operation, the ions of interest pass through slots 31 and accumulate at or on the collection elements 32. The collection elements could then be removed, as desired, and the ions of interest recovered. Of course it will be understood that the collection elements could also have detecting capabilities, for example, to alert the user when the ions of interest have been collected.

According to various embodiments, the presently described tDOF-MS may be used on conjunction with or as part of another analysis instrument. For example, the presently described tDOF-MS could be used as the second stage of an MS/MS instrument, as a detector in gas or liquid chromatography applications, or, as described above, as a method of sample collection/isolation for further analysis, processing, or the like.

Tandem mass spectrometers (MS/MS instruments) have a device between them which operates on the ions mass-selected by the first stage of mass separation to produce ions of different masses. The combination of two stages of mass analysis thus often has a greater degree of selectivity than just having one stage. The present disclosure contemplates the use a tDOF-MS as described herein for the second stage of MS in a tandem instrument, similarly to the way in which the popular quadrupole/TOF combination is used. For example, if the t-DOF-MS is the second stage in an MS/MS instrument, the m/z values selected to detect can be those of particular compounds or of particular compound types. For example, each class of lipid has a unique m/z for it polar head group. A detector set at the m/z of one type of lipids polar head group, would detect just that type of lipid.

The use of tDOF-MS in the second stage provides the greater dynamic range previously described. For targeted analysis, the selected m/z detector arrangement could be used when the instrument was assigned to a particular target for some extended period of use.

Similarly, if the tDOF-MS instrument described herein is used as a detector in gas or liquid chromatography, it can be set to respond to only compounds of a certain type. This type of selective detector is often able to detect and quantify mixture components whose response would be overwhelmed by compounds of greater abundance when a non-selective detection system is used. An example is the electron capture detector for gas chromatography which can have detection limits 10-1000 times lower than the "general" flame ionization detector when looking for halogenated compounds.

In reading the present disclosure, it should be understood that a major advantage of the tDOF-MS instrument described herein is that the distinguishing m/z values can be widely separated in mass without any increase in detector cost or complexity. Not only is this part of the detection system greatly simplified, but the logical system (e.g., software) that determines the targeted analytes' concentration and the degree of confidence in its detection is also simple and direct. In general, the amplitudes of the ion m/z values expected and the ones that are contraindicated can be logically and arithmetically combined to provide the desired information. Other factors that could be considered by the analysis software algorithms include the relative amounts of ions at particular m/z values and the absence of ions that could come from an interferent.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

All patents and publications referenced below and/or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

What is claimed is:

1. A mass spectrometer comprising:

an ion source configured to apply an acceleration pulse to an ion sample comprising or suspected of comprising one or more ions of interest having predetermined m/z values;

one or more field-free regions through which ions can travel;

an array comprising:

detector elements positioned to receive ions having the predetermined m/z value; and dummy elements positioned to receive ions not having the predetermined m/z value;

wherein the dummy elements do not produce a detectable signal when ions are collected by them; and a push plate oriented substantially parallel to the ion path and to the array configured to push the ions to the detector array.

2. The mass spectrometer of claim 1 wherein the dummy elements are operably connected to a point having a voltage that enables ion collection.

3. The mass spectrometer of claim 2 wherein the dummy elements are all connected together.

4. The mass spectrometer of claim 2 wherein at least some of the dummy elements are connected to different points.

5. The mass spectrometer of claim 4 wherein the different points have different voltages.

6. The mass spectrometer of claim 4 wherein the different points have the same voltages.

7. The mass spectrometer of claim 1 wherein the detector elements are operably connected to at least one signaling circuit.

8. The mass spectrometer of claim 7 wherein the signaling circuit is auto-ranging or has a non-linear response function.

9. The mass spectrometer of claim 1 wherein the detector and dummy elements are static.

10. The mass spectrometer of claim 1 wherein at least some of the detector and dummy elements are programmable.

11. The mass spectrometer of claim 1 wherein a first array of dummy and active detectors can be removed from the instrument and exchanged with a second array of dummy and active detectors.

12. The mass spectrometer of claim 11 wherein the first array enables the mass spectrometer to detect a first compound or compound type of interest and the second array enables the mass spectrometer to detect a second compound or compound type of interest.

13. The mass spectrometer of claim 1 wherein the detector elements are mechanically movable and wherein moving the detector elements enables the mass spectrometer to detect different ions.

14. The mass spectrometer of claim 7 wherein the detector elements are shaped to optimize the signal resulting from detection of an ion of interest.

15. The mass spectrometer of claim 7 wherein the ratio of detector element to signaling circuit is 1:1.

16. The mass spectrometer of claim 7 wherein mass spectrometer comprises a ratio of detector element to signaling circuit of greater than 1:1.

17. The mass spectrometer of claim 1 wherein the mass spectrometer physically separates the ions of interest from other ions in the ion sample in such a way that the ions of interest can be recovered from the mass spectrometer.

18. The mass spectrometer of claim 17 wherein the array comprises:

a dummy plate with slots positioned such that, in operation, the ions of interest will travel through the slots; and one or more collection elements positioned behind the slots relative to the path of flight of the ions of interest such that the ions of interest are collected by the collection elements after traveling through the slots.

19. The mass spectrometer of claim 18 wherein the collection elements are removable from the mass spectrometer.

20. A method of detecting ions of interest in an ion source comprising;

applying constant momentum acceleration at the ion source for extraction;

extracting the ions in the ion source;

allowing the ions to traverse a field-free region; and applying a voltage to a push plate in the field-free region to push the ions to an array comprising:

detector elements positioned to receive ions having the predetermined m/z values; and dummy elements positioned to receive ions not having the predetermined m/z values;

wherein the dummy elements do not produce a detectable signal when ions are received on them.

21. A method of isolating and collecting ions of interest in an ion source comprising;

applying constant momentum acceleration at the ion source for extraction;

extracting the ions in the ion source;

allowing the ions to traverse a field-free region; and applying a voltage to a push plate in the field-free region to push the ions to an array comprising:

a dummy plate configured to attract and collect ions not of interest, the dummy plate comprising a slot positioned to allow ions of interest to travel through the dummy plate; and a removable plate positioned behind the dummy plate having collector elements positioned thereon so as to receive and collect the ions of interest after they have traveled through the dummy plate.

* * * * *